US010560993B1

(12) United States Patent
Xiong et al.

(10) Patent No.: US 10,560,993 B1
(45) Date of Patent: Feb. 11, 2020

(54) DIMMING CONTROLLER FOR LED DRIVER AND METHOD OF INDIRECT POWER ESTIMATION

(71) Applicant: UNIVERSAL LIGHTING TECHNOLOGIES, INC., Madison, AL (US)

(72) Inventors: Wei Xiong, Madison, AL (US); Theodore E. Kluska, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 0 days.

(21) Appl. No.: 16/296,550

(22) Filed: Mar. 8, 2019

Related U.S. Application Data

(60) Provisional application No. 62/640,200, filed on Mar. 8, 2018.

(51) Int. Cl.
*H05B 33/08* (2006.01)
*H05B 37/02* (2006.01)

(52) U.S. Cl.
CPC ..... *H05B 33/0848* (2013.01); *H05B 37/0263* (2013.01); *H05B 37/0272* (2013.01)

(58) Field of Classification Search
CPC ..... H05B 33/0848; H05B 37/0263; H05B 37/0272
See application file for complete search history.

(56) References Cited

U.S. PATENT DOCUMENTS 5,039,914 A 8/1991 Szuba
5,089,751 A 2/1992 Wong et al.
6,144,539 A 11/2000 Konopka et al.
(Continued)

FOREIGN PATENT DOCUMENTS

EP 2306791 A2 6/2011
WO 2014013377 A2 1/2014

OTHER PUBLICATIONS

NXP: NT3H1101/NT3H1201, NTAG I2C—Energy harvesting NFC Forum Type 2 Tag with field detection pin and I2C interface—Rev. 3.3—Jul. 15, 2015, 265433, Product data sheet—Company Public (accessed online Jun. 6, 2019).

*Primary Examiner* — Raymond R Chai
(74) *Attorney, Agent, or Firm* — Patterson Intellectual Property Law, P.C.; Gary L. Montle; Alex H. Huffstutter

(57) ABSTRACT

A dimming controller is coupled to receive an out-source current from a dimming interface for each LED driver connected thereto. Based on the out-source current received, the controller can estimate the number of connected LED drivers. When the LED driver(s) are determined to be on based on the received out-source current, the dimming controller generates and transmits a dimming control voltage. The dimming controller is programmable with relationships between the dimming control voltage and operational parameters for the certain type of LED driver and the certain type of LED load. The dimming controller then estimates the power characteristics (e.g., the input power and the output power) of the LED driver and associated LED load based on the programmed relationships. Power characteristics can accordingly be reported to the customer via a dimming controller without requiring specifically designed power measuring devices. Driver failure in the group can be reported in real time.

20 Claims, 5 Drawing Sheets

(56) References Cited

U.S. PATENT DOCUMENTS

| | | | | |
|---|---|---|---|---|
| 6,204,613 | B1 | 3/2001 | Hesterman | |
| 6,356,027 | B1 | 3/2002 | Zhang et al. | |
| 7,333,353 | B2 | 2/2008 | Yin | |
| 7,750,577 | B2 | 7/2010 | Nerone et al. | |
| 8,654,485 | B1 | 2/2014 | Koehler | |
| 8,853,958 | B2 | 10/2014 | Athalye et al. | |
| 8,928,236 | B1 | 1/2015 | Mays, II et al. | |
| 9,125,259 | B1 | 9/2015 | Xiong | |
| 9,131,581 | B1 | 9/2015 | Hsia et al. | |
| 9,408,273 | B2 | 8/2016 | Wee et al. | |
| 9,414,457 | B2 | 8/2016 | Fukuda et al. | |
| 9,565,744 | B2 | 2/2017 | Lai et al. | |
| 9,629,209 | B1 | 4/2017 | Xiong et al. | |
| 9,648,678 | B1 | 5/2017 | Xiong et al. | |
| 9,681,512 | B1 | 6/2017 | Xiong et al. | |
| 9,693,411 | B1 | 6/2017 | Xiong et al. | |
| 9,723,667 | B1 | 8/2017 | Xiong et al. | |
| 10,264,641 | B1 | 4/2019 | Mays, II et al. | |
| 2009/0079357 | A1 | 3/2009 | Shteynberg et al. | |
| 2010/0102747 | A1 | 4/2010 | Ilyes et al. | |
| 2010/0181935 | A1 | 7/2010 | Wu | |
| 2011/0285311 | A1 | 11/2011 | Yang et al. | |
| 2012/0249001 | A1 | 10/2012 | Okubo et al. | |
| 2012/0262432 | A1 | 10/2012 | Kamata et al. | |
| 2012/0286681 | A1 | 11/2012 | Hausman, Jr. | |
| 2013/0069561 | A1* | 3/2013 | Melanson | H05B 33/0815 315/297 |
| 2013/0082604 | A1 | 4/2013 | Williams et al. | |
| 2014/0117868 | A1 | 5/2014 | Lopez et al. | |
| 2014/0125241 | A1 | 5/2014 | Elferich et al. | |
| 2014/0145607 | A1 | 5/2014 | Goscha et al. | |
| 2014/0253562 | A1 | 9/2014 | Yaras | |
| 2014/0285109 | A1 | 9/2014 | Liao et al. | |
| 2014/0303782 | A1 | 10/2014 | Pruchniewski et al. | |
| 2015/0054423 | A1 | 2/2015 | Tyson et al. | |
| 2015/0061638 | A1 | 3/2015 | Reh et al. | |
| 2015/0091461 | A1 | 4/2015 | Nakamura et al. | |
| 2015/0180337 | A1 | 6/2015 | Ooga | |
| 2015/0208469 | A1 | 7/2015 | Coetzee et al. | |
| 2015/0230303 | A1 | 8/2015 | Gong et al. | |
| 2015/0264755 | A1 | 9/2015 | Hsia et al. | |
| 2015/0327340 | A1 | 11/2015 | Siessegger et al. | |
| 2016/0242253 | A1 | 8/2016 | Bhagwat et al. | |
| 2016/0249428 | A1* | 8/2016 | Bandel | H05B 33/0854 |
| 2016/0299555 | A1 | 10/2016 | Rucker et al. | |
| 2017/0295630 | A1* | 10/2017 | Lark, Jr. | H05B 37/0272 |
| 2018/0035496 | A1* | 2/2018 | Nieuwlands | H05B 33/0887 |
| 2018/0070419 | A1* | 3/2018 | Girard | H05B 33/0818 |

* cited by examiner

DIMMING CONTROLLER FOR LED DRIVER AND METHOD OF INDIRECT POWER ESTIMATION

CROSS-REFERENCES TO RELATED APPLICATIONS

This application claims benefit of U.S. Provisional Application No. 62/640,200 filed Mar. 8, 2018, entitled "0-10 v Dimming Controller with Indirect Power Estimation Capability for LED Driver," and which is hereby incorporated by reference.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

FIELD OF THE INVENTION

The present invention relates generally to circuitry and methods for measuring output active power through a light source such as a light emitting diode (LED) load. More particularly, the present invention relates to circuitry and methods for indirectly estimating output active power through a LED load powered by an LED driver using a 0-10 v dimming interface.

BACKGROUND

LED lighting is increasingly popular due for example to its relatively long life, better lumen output per watt than alternative lighting techniques, and superior dimming capability. Traditional LED drivers lack inherent capability to report individual driver power consumption information to the customer. However, it is very desirable for a customer to have this information to better manage the power consumption in a given facility.

In a typical AC power distributing system, the average power is defined by:

$$P_{average} = \frac{1}{T} \cdot \int_0^T v(t) \cdot i(t) dt \tag{1}$$

If a current has a phase shift a with respect to the voltage, then the average active power can be calculated as:

$$\frac{1}{2 \cdot \frac{\pi}{w}} \cdot \int_0^{2 \cdot \frac{\pi}{w}} v_{rms} \cdot \sqrt{2} \cdot \cos(w \cdot t) \cdot I_{rms} \cdot \sqrt{2} \cdot \cos(w \cdot t - a) dt \rightarrow I_{rms} \cdot V_{rms} \cdot \cos(a)$$

which simplifies to:

$$P_\text{average} = I_{rms} \cdot V_{rms} \cdot \cos(a) \tag{2}$$

with $I_{rms}$ being the RMS input current and $V_{rms}$ being the RMS input voltage.

Most of the time utility companies only charge customers for active power or average power. From equation (2) we see that we need to know the RMS input current $I_{rms}$, the RMS input voltage $V_{rms}$, and the phase shift a to accurately calculate active input power. Unfortunately, it is exceedingly costly to implement circuitry designed to accurately measure those three necessary variables.

BRIEF SUMMARY

Accordingly, there is a need in dimming systems and methods for performing power estimation at a low cost in order to be able to feedback the total power consumption (e.g., the input power and the output power) to the customer for improving power management. The proposed method can effectively achieve that goal without adding any costly dedicated measurement devices for directly measuring the power consumption. Rather, various embodiments of a dimming controller as disclosed herein can indirectly estimate the output active power through 0-10V dimming interface and report the power to a customer through wireless communication or cable network.

An exemplary embodiment of a dimming controller and method is disclosed herein for group controlling and estimating power consumption of one or more LED drivers configured to drive respective LED loads. The dimming controller includes one or more dimming interface terminals linked to the one or more LED drivers via respective lines, and is further configured to receive a dimming command input signal via a communications module from for example an external device or server. The dimming controller senses an out-source current associated with the one or more LED drivers, via for example a current sensing resistor coupled in series with at least one of the one or more dimming interface terminals, and generates a dimming control output signal associated with the dimming command input signal across the one or more dimming interface terminals. The dimming controller further estimates power characteristics of the one or more LED drivers and associated LED loads based on programmed relationships between the dimming control output signal and one or more operational parameters for a certain type of LED driver and LED load of the one or more LED drivers and associated LED loads.

In another exemplary embodiment, the dimming controller may be programmed with relationships between the received dimming command input signal and the one or more operational parameters for the certain type of LED driver and LED load.

In another embodiment, the dimming controller reports the estimated power consumption of the one or more LED drivers and associated loads from the dimming controller to a user computing device. Accordingly, power characteristics may be reported to the customer relying only on the dimming controller and without requiring any specifically designed power measuring device. Another potential advantage is that an LED driver failure in the group may further be reported in real time.

In another embodiment, the dimming controller determines whether the one or more LED drivers are in an on-state based on the sensed out-source current, and generates the dimming control output signal associated with the dimming command input signal across the one or more dimming interface terminals when the one or more LED drivers are determined to be in an on-state.

The dimming controller may further determine a total number of LED drivers of the one or more LED drivers in the on-state and connected to the dimming controller by dividing the sensed out-source current by a predetermined out-source current expected for each of one or more LED drivers, the predetermined driver out-source current being one of the one or more operational parameters for the certain type of LED driver.

In another embodiment, the programmed relationships between the received dimming control voltages and the one or more operational parameters for a certain type of LED driver and LED load include: a relationship between an LED current for the certain type of LED load and the received dimming control voltage; a relationship between the LED current for the certain type of LED load and an LED voltage for the certain type of LED load; and a relationship between a driver efficiency for the certain type of LED driver and an output power of each LED load of the one or more LED drivers.

In another embodiment the dimming controller, or an external processing device upon receiving power characteristic data from the dimming controller, calculates an LED current of each LED load according to a predetermined and programmed relationship between the LED current for the certain type of LED load and the received dimming control voltage.

In another embodiment the dimming controller, or an external processing device upon receiving power characteristic data from the dimming controller, calculates an LED voltage of each LED load according to a predetermined and programmed relationship between the LED current for the certain type of LED load and the LED voltage for the certain type of LED load.

The dimming controller, or an external processing device upon receiving power characteristic data from the dimming controller, may further calculate an output power of each LED load based at least in part on the LED current and LED voltage of each LED load, and an input power of the LED driver according to a predetermined and programmed relationship between the output power and a driver efficiency of the one or more LED driver for the certain type of LED driver.

The dimming controller, or an external processing device upon receiving power characteristic data from the dimming controller, may further calculate a total output power of the one or more LED drivers and associated LED loads based at least in part on the LED current of each LED load, the LED voltage of each LED load, and a total number of LED drivers of the one or more LED drivers connected to the external device and in an on-state, the total number of LED drivers calculated by dividing the sensed out-source current by an individual out-source current of the each of one or more LED drivers.

The dimming controller, or an external processing device upon receiving power characteristic data from the dimming controller, may further calculate a total input power of the one or more LED drivers and associated LED loads according to a predetermined and programmed relationship between the total output power and a driver efficiency of the one or more LED driver for the certain type of LED driver.

DETAILED DESCRIPTION OF THE INVENTION

Figure 1:
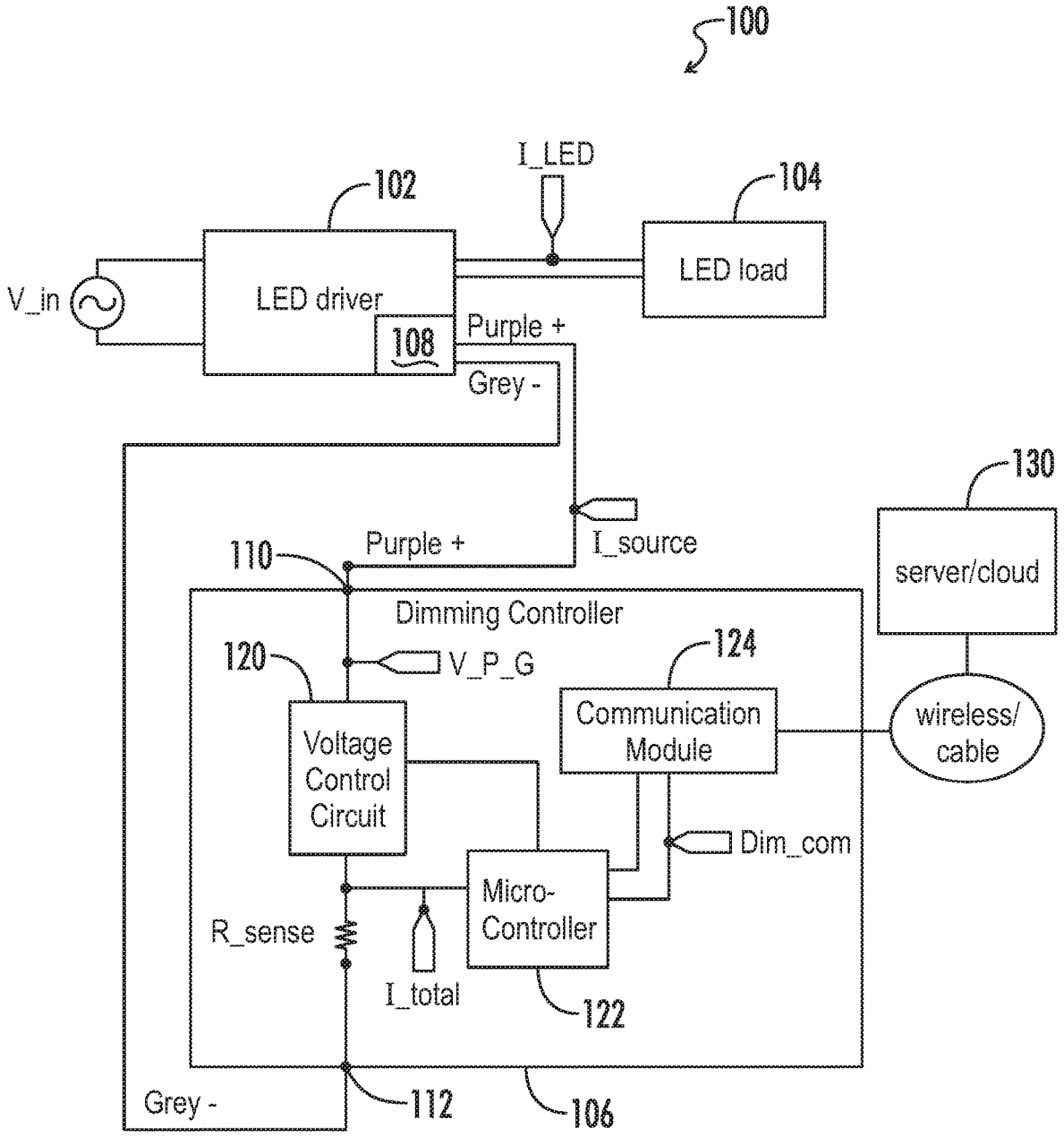
FIG. 1 is a circuit block diagram representing an LED driver system for group control and power consumption estimation of a single LED driver in accordance with the present disclosure.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

Referring generally to FIGS. 1-6, an exemplary LED driver system 100 and associated methods are now illustrated in greater detail. The LED driver system 100 includes one or more LED drivers 102, each having an associated LED load 104, and a dimming controller 106 (or external device 106) coupled to each of the one or more LED drivers 102. The dimming controller 106 is coupled to a dimming control interface 108 of each LED driver of the one or more LED 102. The one or more LED drivers 102 are coupled to a voltage source V_in. The voltage source V_in may be an AC mains input V_in.

As can best be seen in FIG. 1, a single driver configuration of the LED driver system 100 is shown having only one LED driver 102 coupled to the voltage source V_in. As can best be seen in FIG. 5, a multi-driver configuration of the LED driver system 100 is shown having a plurality of LED drivers 102 (e.g., 102*a*, 102*b*, 102*c*, etc.) coupled in parallel across the voltage source V_in.

Each of the one or more LED drivers 102 may be substantially identical and each of the associated LED loads may be substantially identical. The one or more LED drivers 102 may be of a certain type of LED driver. The certain type of LED driver may be any available LED driver, currently being produced or that may be produced in the future, that has a dimming control interface 108. The associated LED load 104 may be any available LED load, currently being produced or that may be produced in the future, that is capable of being dimmed. The associated LED load 104 may be an array of one or more LEDs, arranged in series and/or in parallel.

Each LED driver of the one or more LED drivers 102 is configured to generate an out-source current I_source at its respective dimming control interface 108 when the respective LED driver is in an on-state. For a certain type of LED driver, the out-source current I_source is substantially constant. The dimming controller 106 is configured to sense a total out-source current I_total generated by the one or more LED drivers 102. The total out-source current may be a summation of each out-source current I_source of the one or more LED drivers 102 when in the on-state.

The dimming controller 106 may be configured to generate a dimming control voltage V_P_G to a 0-10V dimming interface of an LED driver connected thereto via the interface terminals (e.g., Purple and Grey). The dimming control voltage is provided for controlling an LED current I_LED that is generated by each of the one or more LED drivers 102 and supplied to the associated LED load 104. In an embodiment, the one or more LED drivers generate the LED current by providing drive signals to one or more switching elements in a power stage having output terminals coupled to the LED load.

The dimming controller 106 is further configured to estimate power characteristics (e.g., an output power P_LED and an input power P_in; also known as power consumption) of the one or more LED drivers 102 and the associated LED loads 104 based on programmed relationships between a range of dimming control voltages and one or more operational parameters for a certain type of LED driver and a certain type of LED load of the one or more LED drivers 102 and associated LED loads 104. The range of dimming control voltages may be any voltage between a first dimming control voltage V1_P_G and a second dimming control voltage V2_P_G.

The dimming controller 106 is selectively configured to operate at any given time in what herein may be referred to as a first operating mode, a second operating mode, and a third operating mode. The first operating mode may be associated with programming the relationships between the range of dimming control voltages and the one or more operational parameters into the dimming controller 106. The second operating mode may occur when the dimming controller 106 senses a total out-source current I_total of zero (e.g., when none of the one or more LED drivers 102 is operating in the on-state). In the second operating mode the dimming controller 106 is idle (e.g., the dimming controller 106 constantly monitors and awaits the total out-source current I_total to be greater than zero). The third operating mode may occur when the total out-source current I_total is greater than zero. In the third operating mode, the dimming controller 106 at least generates the dimming control voltage V_P_G and estimates the power characteristics of the one or more LED drivers 102 and the associated LED loads 104.

Figure 2:
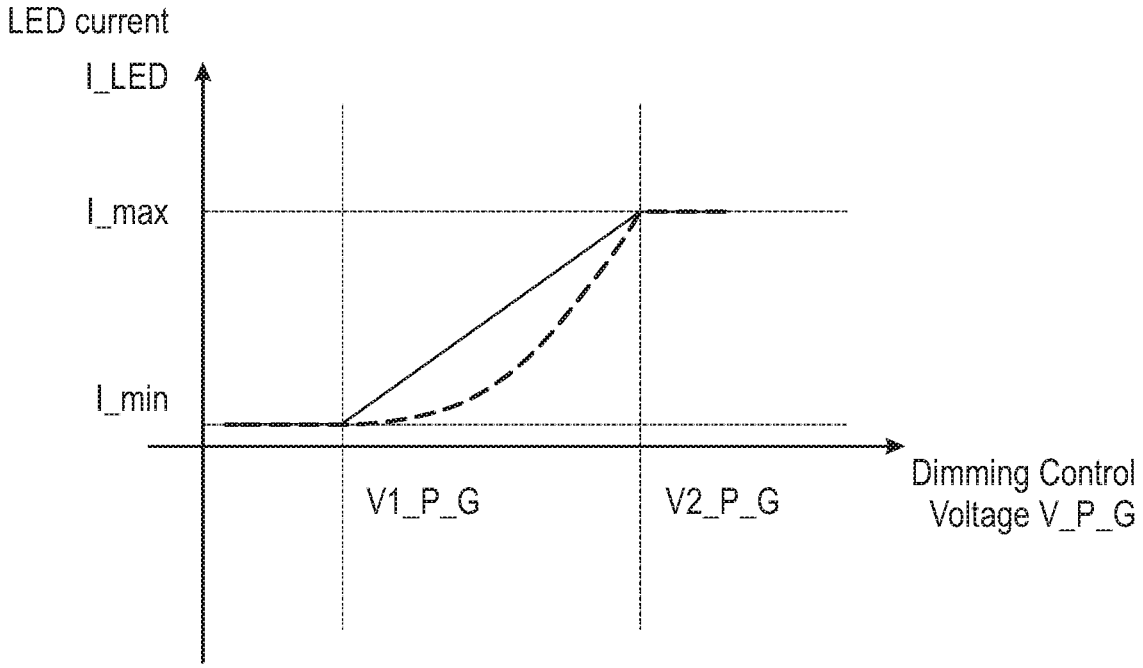
FIG. 2 is a graphical diagram representing a relationship between a dimming control voltage and an LED current for a certain type of LED load in accordance with the present disclosure.

As can best be seen in FIG. 2, one such relationship that is programmed into the dimming controller 106 is a relationship between the LED current I_LED generated by the one or more LED drivers 102 and supplied to the certain type of LED load and the dimming control voltage V_P_G generated by the dimming controller 106. The certain type of LED load may be configured to operate between a maximum LED current I_max and a minimum LED current I_min. The relationship between the LED current I_LED and the dimming control voltage V_P_G can be defined by the function:

$$I_\mathrm{LED}=f(V_P_G) \tag{3}$$

From equation (3), for a certain dimming control voltage V_P_G, an estimated LED current can always be calculated without physically measuring the true LED current.

Figure 3:
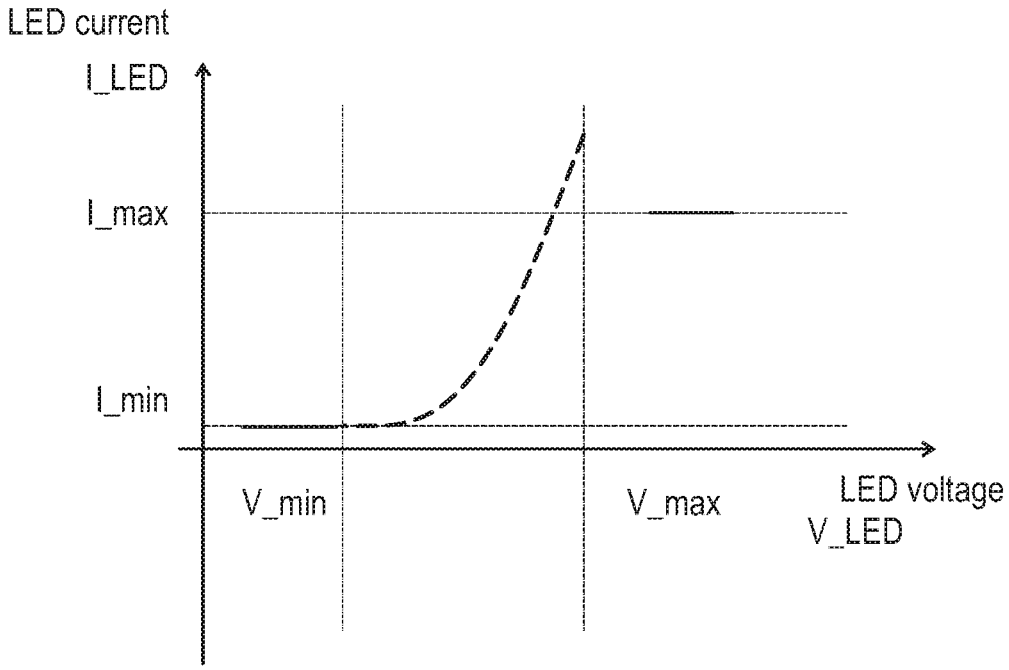
FIG. 3 is a graphical diagram representing a relationship between the LED current for a certain type of LED load and an LED voltage for the certain type of LED load in accordance with the present disclosure.
Figure 4:
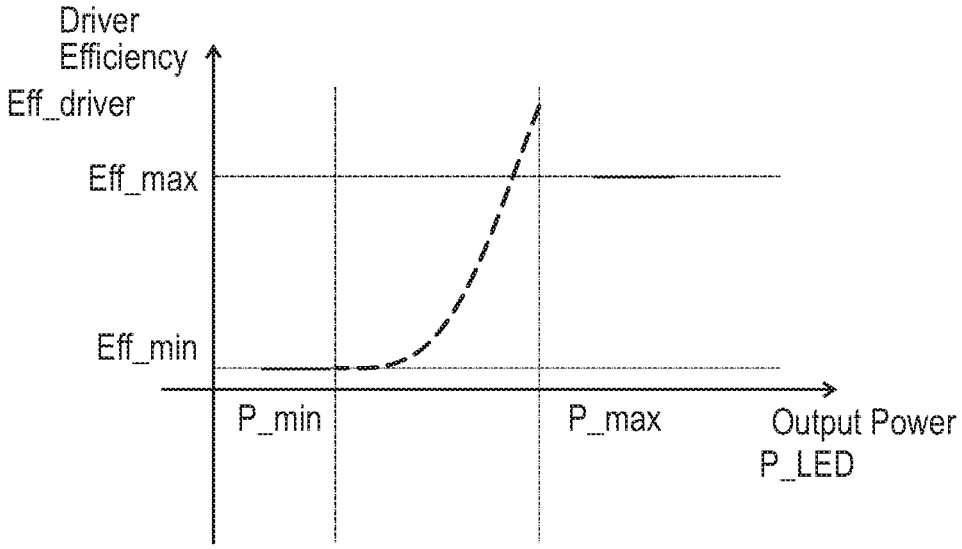
FIG. 4 is a graphical diagram representing a relationship between an output power of a certain type of LED load and a driver efficiency for a certain type of LED driver in accordance with the present disclosure.

As can best be seen in FIG. 3, another such relationship that is programmed into the dimming controller 106 is a relationship between the LED current I_LED and an LED voltage V_LED for the certain type of LED load that is connected to the one or more LED drivers 102. The certain type of LED load may be operatively configured to operate between a maximum LED voltage V_max and a minimum LED voltage V_min. This relationship can be measured and programmed into the dimming controller 106. The relationship between the LED current I_LED and the LED voltage V_LED can be defined as:

$$V_\mathrm{LED}=K(I_\mathrm{LED}) \tag{4}$$

From equation (4), for a certain LED current I_LED, an estimated LED voltage V_LED can always be calculated without physically measuring the true LED voltage.

For a certain type of LED load, if the dimming control voltage V_P_G is given, then an estimated output power P_LED (or LED power) can be calculated as:

$$P_\mathrm{LED}=I_\mathrm{LED}\cdot V_\mathrm{LED}=f(V_P_G)\cdot K(I_\mathrm{LED})=f(V_P_G)\cdot K(f(V_P_G)) \tag{5}$$

Accordingly, there is a relationship between the output power P_LED and the dimming control voltage V_P_G can be defined as:

$$P_\mathrm{LED}=f(V_P_G)\cdot K(f(V_P_G)) \tag{6}$$

A driver efficiency Eff_driver of the one or more LED drivers 102 connected to a certain type LED load can be measured. As can best be seen in FIG. 4, another such relationship that is programmed into the dimming controller 106 is a relationship between the driver efficiency Eff_driver of the one or more LED drivers 102 for the certain type LED load of the associated LED load 104 connected to the respective LED driver and the output power P_LED of the associated LED load 104. This relationship can be easily measured and programmed into the dimming controller 106. The certain type of LED load may be operatively configured to operate between a maximum output power P_max and a minimum output power P_min. The certain type of LED driver may be operatively configured to operate between a maximum driver efficiency Eff_max and a minimum driver efficiency Eff_min. The relationship between the driver efficiency Eff_driver and the output power P_LED can be defined as:

$$\mathrm{Eff_driver}=G(P_\mathrm{LED}) \tag{7}$$

The driver efficiency Eff_driver may also be directly calculated by comparing the output power P_LED to an input power P_in for a certain type of LED driver with a certain type of LED load connected thereto, as follows:

$$\mathrm{Eff_driver}=\frac{\mathrm{P_LED}}{\mathrm{P_in}} \tag{8}$$

From equations 6, 7, and 8, the input power P_in for the certain type of LED driver connected to the certain type of LED load at a certain dimming control voltage within the range of dimming control voltages can be calculated as:

$$\mathrm{P_in}=\frac{\mathrm{P_LED}}{G(f(\mathrm{V_P_G})\cdot K(f(\mathrm{V_P_G})))} \tag{9}$$

When there is only one driver 102 connected to the dimming controller 106 (e.g., the single driver configuration of the LED driver system 100), a voltage V_sense across the current sensing resistor R_sense, for a single driver, may be calculated as:

$$V_\mathrm{sense}=I_\mathrm{source}\cdot R_\mathrm{sense} \tag{10}$$

As has just be demonstrated, the LED driver system 100 estimates the power characteristics (e.g., the input power P_in and the output power P_LED) of the one or more LED drivers 102 and associated LED loads 104 using the dimming Dim-com received by the dimming controller 106 of the LED driver system 100. The LED driver system 100 eliminates the need to directly measure the true LED Current and LED voltage. Accordingly, the LED driver system 100 performs these power characteristics estimations without the need for additional, often costly, circuitry added to the one or more LED drivers 102 and associated LED loads 104 for directly measuring the true power characteristics.

Figure 5:
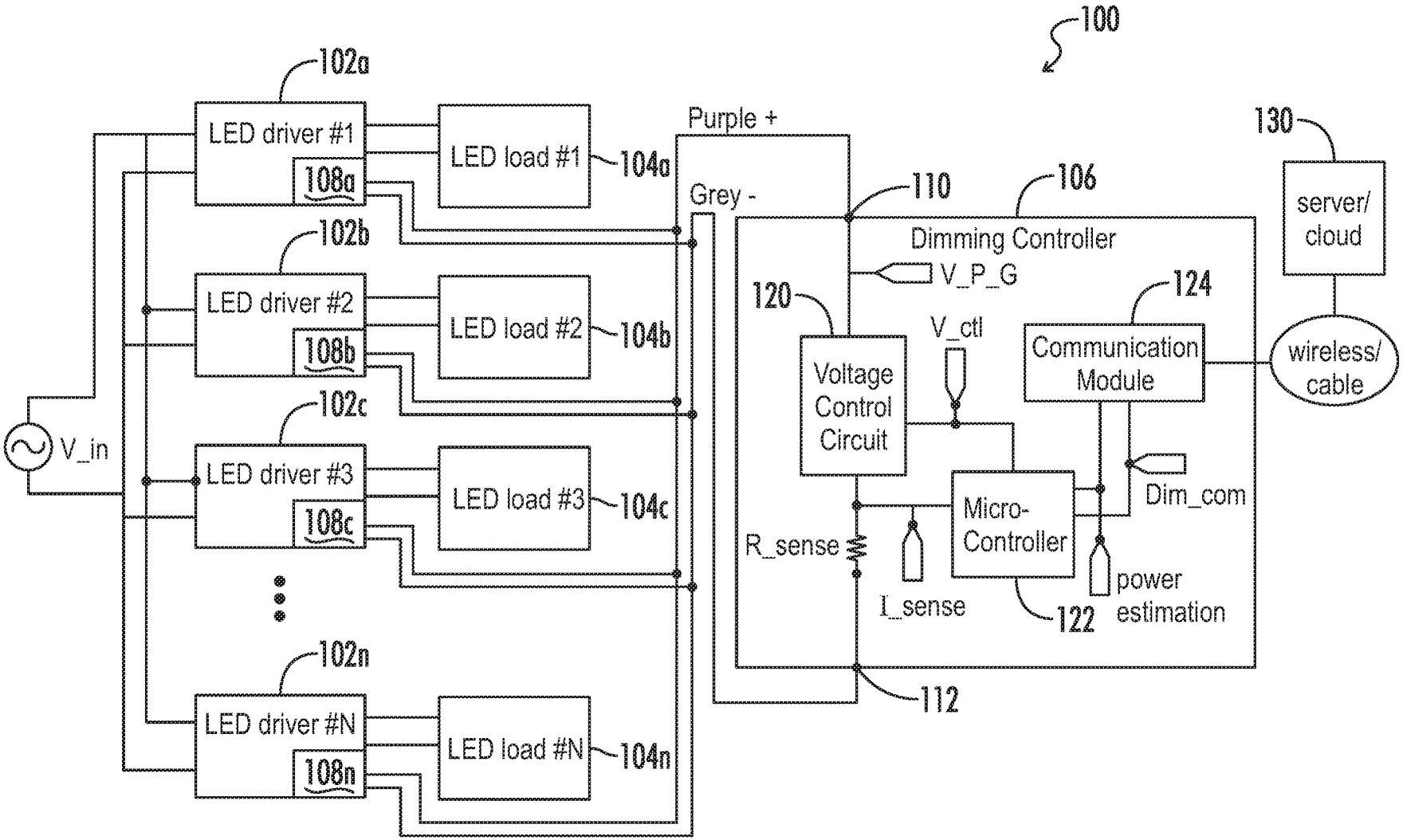
FIG. 5 is a circuit block diagram representing an LED driver system for group control and power consumption estimation of one or more LED drivers in accordance with the present disclosure.

As can best be seen in FIGS. 1 and 5, additional details of the dimming controller 106 of the LED driver system 100 are provided. The dimming controller 106 includes an input terminal 110 and an output terminal 112. The input and output terminals 110, 112 are configured to couple to the dimming control interface 108 of each of the one or more LED drivers 102. The input terminal 110 of the dimming controller 106 may be configured to receive the out-source current I_source from each of the one or more LED drivers 102. The dimming controller 106 is further configured to apply the dimming control voltage V_P_G across the input and output terminals 110, 112 in order to control the LED current I_LED that is generated by each of the one or more LED drivers 102 and supplied to the associated LED load 104.

The dimming controller 106 includes a voltage control circuit 120, a current sensing resistor R_sense, a controller 122, and a communications module 124. The voltage control circuit 120 is coupled in series with the current sensing resistor R_sense between the input and output terminals 110, 112. The controller 122 is coupled to the voltage control circuit 120, the communications module, and a node between the voltage control circuit 120 and the current sensing resistor R_sense.

The terms "controller," "control circuit" and "control circuitry" as used herein may refer to, be embodied by or otherwise included within a machine, such as a general purpose processor, a digital signal processor (DSP), an application specific integrated circuit (ASIC), a field programmable gate array (FPGA) or other programmable logic device, discrete gate or transistor logic, discrete hardware components, or any combination thereof designed and programmed to perform or cause the performance of the functions described herein. A general purpose processor can be a microprocessor, but in the alternative, the processor can be a controller, microcontroller, or state machine, combinations of the same, or the like. A processor can also be implemented as a combination of computing devices, e.g., a combination of a DSP and a microprocessor, a plurality of microprocessors, one or more microprocessors in conjunction with a DSP core, or any other such configuration.

The dimming control voltage V_P_G is generated by the voltage control circuit 120 between the input and output terminals 110, 112 of the dimming controller 106. The controller 122 is configured to control the dimming control voltage V_P_G generated by the voltage control circuit 120 based on a dimming command input signal Dim_com received from the communications module 124. The communications module 124 receives the dimming command input signal Dim_com. The communications module 124 then transmits the dimming command input signal Dim_com to the controller 122, which uses the dimming command input signal Dim_com to control the dimming control voltage V_P_G generated by the voltage control circuit 120.

The current sensing resistor R_sense is used to sense and measure the total out-source current I_total of the one or more LED drivers 102. The total out-source current is equivalent to a summation of the out-source currents I_source from each of the one or more LED drivers 102. The controller 122 senses the total out-source current I_total using its connection to the node between the voltage control circuit 120 and the current sensing resistor R_sense. The controller 122 senses that there is a current going through the current sensing resistor R_sense when at least one of the one or more LED drivers 102 is in the on-state.

In the first operating mode, the controller 122 of the dimming controller 106 may be programmed with the relationships between the range of dimming control voltages and the one or more operational parameters into the dimming controller 106. In the first operating mode, the communications module 124 is used for programming the certain LED driver and the certain LED load of the one or more LED drivers 102 and associated LED loads 104 into the controller 122 of the dimming controller 106 of the LED driver system 100.

In the second operating mode, the controller 122 senses that the total out-source current I_source through the current sensing resistor is equal to zero. In the second operating mode, the controller 122 is idle (e.g., the controller 122 constantly monitors and awaits the total out-source current I_total to be greater than zero).

In the third operating mode, the controller 122 senses that the total out-source current I_source through the current sensing resistor is greater than zero. In the third operating mode, the controller 122 controls the voltage control circuit 120 to maintain a certain dimming control voltage V_P_G according to the dimming command input signal Dim_com. In the third operating mode, the controller 122 also calculates the estimated power characteristics of the one or more LED drivers 102 and the associated LED loads 104 according to equations (6) and (9). In the third operating mode, the controller 122 feeds the estimated power characteristics to the communications module 124.

The communications module 124 is configured to communicate with an external cloud 130 (or a server 130) either wirelessly or via a wired connection. The communications module 124 is configured to report the input power P_in and the output power P_LED (e.g., power consumption) of the one or more LED drivers 102 and associated LED loads 104 of the LED driver system 100 back to the external cloud 130. The communications module 124 allows the power characteristics (or power consumption) to be reported in real time back to the customer for optimizing power management.

Referring now to FIG. 5, the multi-driver configuration of the LED driver system 100 is shown. The functionality of the multi-driver configuration of the LED driver system 100 will now be explained in greater detail. This configuration may occur, for example, when there are multiple lighting fixtures mounded on a ceiling to provide lighting to an area. Furthermore, in this example, there could be multiple LED drivers and LED loads in each fixture. If all of the fixtures have identical LED drivers 102 and LED loads 104, then the dimming controller 106 (e.g., a single dimming controller) as described with regard to the single driver configuration of the LED driver system 100 can be used to perform group control of the one or more LED drivers 102 (e.g., 102*a*, 102*b*, 102*c*, . . . , 102*n*) and associated LED loads 104 (e.g., 104*a*, 104*b*, 104*c*, . . . , 104*n*). Each LED driver includes a dimming control interface (e.g., 108*a*, 108*b*, 108*c*, . . . , 108*n*).

The controller 122 in the multi-driver configuration of the LED driver system 100 performs several additional calculations when estimating the power characteristics of the one or more LED drivers 102 and associated LED loads 104. Most importantly, the controller 122 must calculate a total number of LED drivers N of the one or more LED drivers 102 that are in the on-state and coupled to the dimming controller 106. By sensing the voltage V_sense across the current sensing resistor R_sense, the controller 122 of the dimming controller 106 can calculate the total number of LED drivers N that are in the on-state and coupled to the dimming controller 106.

When more than one driver is connected to the dimming controller 106, the total out-source current I_total can be calculated as:

$$I_total = N \cdot I_source \tag{11}$$

From equations (10) and (11), a total voltage V_total across the current sensing resistor R_sense, when more than one driver is connected to the dimming controller 106, can be calculated as:

$$V_total = I_total \cdot R_sense = N \cdot I_source \cdot R_sense = N \cdot V_sense \tag{12}$$

Accordingly, the controller 122 may calculate the total number of LED drivers N that are in the on-state and coupled to the dimming controller 106 by dividing the total voltage V_total sensed across the current sensing resistor R_sense by the voltage V_sense across the current sensing resistor R_sense for a single driver. Alternatively, the controller 122 may calculate the total number of LED drivers N that are in the on-state and coupled to the dimming controller 106 by dividing the total out-source current I_total sensed across the current sensing resistor R_sense by the out-source current I_source for the certain LED driver of the one or more LED drivers 102.

When calculating a total input power P_in_total and a total output power P_LED_total for the one or more LED drivers 102 and associated LED loads 104 connected to the dimming controller 106 in the multi-driver configuration of the LED driver system 100, the controller 122 of the dimming controller 106 will multiply power characteristics for the single driver configuration (e.g., the output power P_LED and the input power P_in) by the number of LED drivers N that are in the on-state and that are coupled to the dimming controller 106.

The total output power P_LED_total may be calculated by the controller 122 as:

$$P_LED_total = N \cdot f(V_P_G) \cdot K(f(V_P_G)) \tag{13}$$

The total input power P_in_total may be calculated by the controller 122 as:

$$P_in_total = \frac{P_LED_total}{G(f(V_P_G) \cdot K(f(V_P_G)))} \tag{14}$$

The dimming controller 106 of the LED driver system 100 can effectively control one or more LED drivers 102 and the associated LED loads 104. The dimming controller 106 can also effectively report the estimated power characteristics to the customer without adding dedicated measurement devices for the LED current I_LED, the LED voltage V_LED, an input current, or the input voltage V_in. The LED driver system 100 is extremely cost effecting and has high accuracy when correlation between the dimming control voltage V_P_G, the LED current I_LED, the LED voltage V_LED, and the driver efficiency Eff_driver are well predicted.

Figure 6:
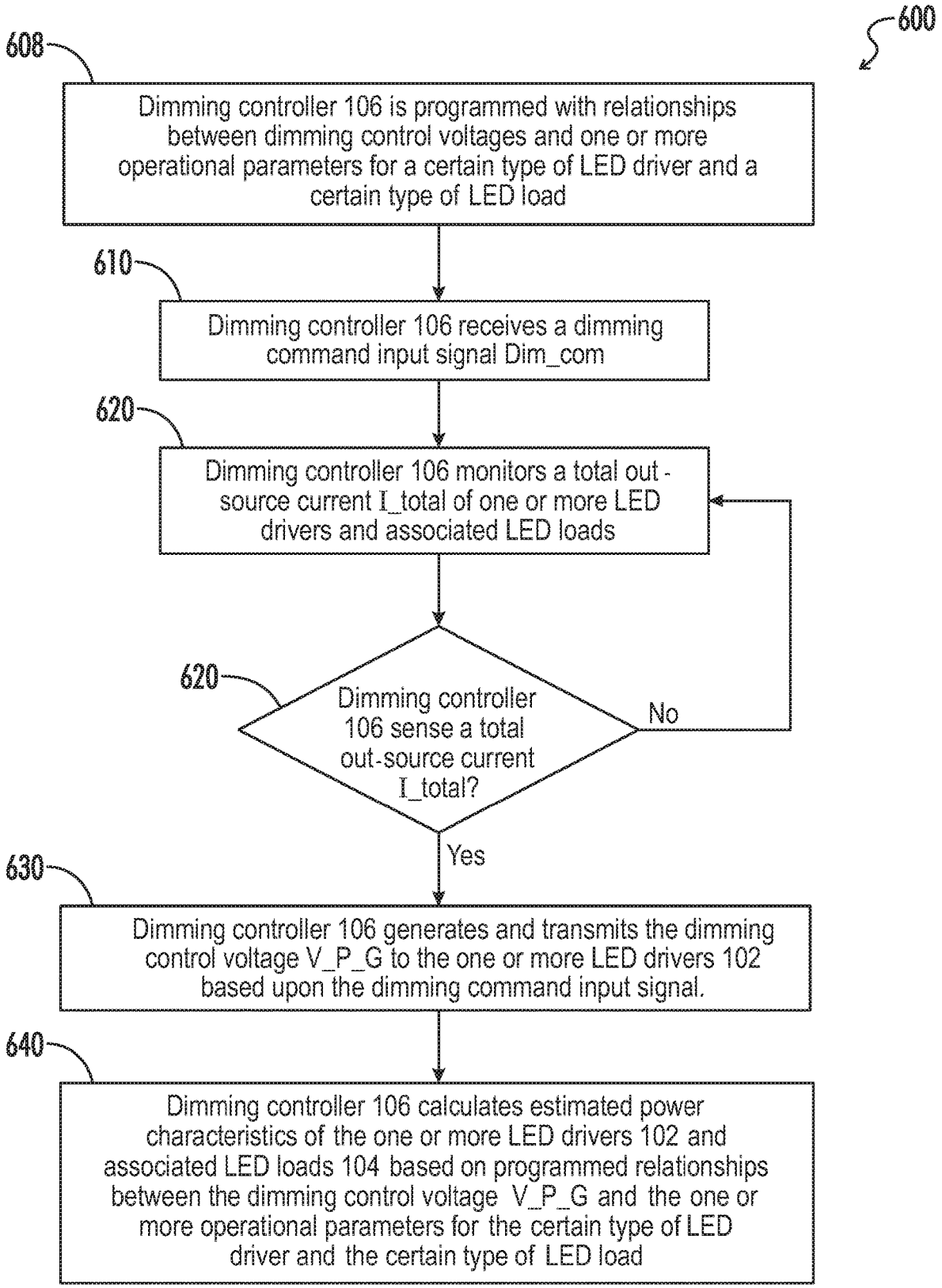
FIG. 6 is a flowchart representing an exemplary method of group controlling and estimating power consumption of one or more LED drivers, each with a respective LED load in accordance with the present disclosure.

Referring now to FIG. 6, a process flow for a method of group controlling and estimating the power consumption 600 of one or more LED drivers 102, each configured to drive an associated LED load 104, is provided. The method includes receiving (610) the dimming command input signal Dim_com at the dimming controller 106. The method also includes sensing (620) the total out-source current I_total associated with the one or more LED drivers 102 (e.g., the dimming controller 106 may continually monitor the total out-source current I_total). The method further includes generating and transmitting (630) the dimming control voltage V_P_G from the dimming controller 106 to the one or more LED drivers 102. The method finally includes estimating (640) (via calculation) power characteristics (e.g., the output power P_LED and/or the total output power P_LED_total, and the input power P_in and/or the total input power P_in_total) of the one or more LED drivers 102 and associated LED loads 104 based on programmed relationships between the range of dimming control voltages and the one or more operational parameters for the certain type of LED driver and the certain type of LED load of the one or more LED drivers 102 and associated LED loads 104.

The method may also include the step of programming (608) the dimming controller 106 with the relationships between the range of dimming control voltages and the one or more operational parameters for the certain type of LED driver and the certain type of LED load. This step may occur during the first operational mode.

The method may also include the step of connecting the one or more LED drivers 102 and associated LED loads 104 in parallel to the voltage source V_in. Each of the one or more LED drivers 102 and associated LED loads 104 is also connected to the dimming controller 106. The one or more LED drivers 102 and associated LED loads 104 connected to the dimming controller 106 are identical.

The method may further include the step of reporting the estimated power characteristics of the one or more LED drivers 102 and associated LED loads 104 from the dimming controller 106 to the customer via the external cloud 130.

The method may further include the steps of determining whether the one or more LED drivers 102 is in an on-state based on the total sensed out-source current I_total and determining the total number of LED drivers N that are in the on-state and connected to the dimming controller 106.

The step of estimating the power characteristics of the method may include calculating the LED current I_LED of each LED load 104 according to a predetermined and programmed relationship between the LED current I_LED for the certain type of LED load and the received dimming control voltage V_P_G.

The step of estimating the power characteristics of the method may also include calculating the LED voltage V_LED of each LED load 104 according to a predetermined and programmed relationship between the LED current I_LED for the certain type of LED load and the LED voltage V_LED for the certain type of LED load.

In the single driver configuration, the step of estimating the power characteristics of the method may further include calculating the output power P_LED of the LED load based at least in part on the dimming control voltage V_P_G, the LED current I_LED of each associated LED load 104, and the LED voltage V_LED of each associated LED load 104. Step (d) may also include calculating the input power P_in according to a predetermined and programmed relationship between the output power P_LED and the driver efficiency Eff_driver for the certain type of LED driver of the one or more LED drivers 102.

In the multi-driver configuration, the step of estimating the power characteristics of the method may further include calculating the total output power P_LED_total of the one or more LED drivers 102 and associated LED loads 104 based at least in part on the dimming control voltage V_P_G, the LED current I_LED of each associated LED load 104, the LED voltage V_LED of each associated LED load 104, and the total number of LED loads N. Step (d) may also include calculating the total input power P_in_total according to a predetermined and programmed relationship between the total output power P_LED_total and the driver efficiency Eff_driver for the certain type of LED driver of the one or more LED drivers 102.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims. The phrase "in one embodiment," as used herein does not necessarily refer to the same embodiment, although it may.

The term "circuit" means at least either a single component or a multiplicity of components, either active and/or passive, that are coupled together to provide a desired function. Terms such as "wire," "wiring," "line," "signal," "conductor," and "bus" may be used to refer to any known structure, construction, arrangement, technique, method and/or process for physically transferring a signal from one point in a circuit to another. Also, unless indicated otherwise from the context of its use herein, the terms "known," "fixed," "given," "certain" and "predetermined" generally refer to a value, quantity, parameter, constraint, condition, state, process, procedure, method, practice, or combination thereof that is, in theory, variable, but is typically set in advance and not varied thereafter when in use.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

The previous detailed description has been provided for the purposes of illustration and description. Thus, although there have been described particular embodiments of a new and useful invention, it is not intended that such references be construed as limitations upon the scope of this invention except as set forth in the following claims.

What is claimed is:

1. A method of group controlling and estimating power consumption of one or more LED drivers configured to drive respective LED loads, each LED driver of the one or more LED drivers configured to generate an out-source current while the LED driver is in an on-state, the method comprising the steps of:

(a) receiving a dimming command input signal at a dimming controller having one or more dimming interface terminals linked to the one or more LED drivers;

(b) sensing a total out-source current associated with the one or more LED drivers, the total out-source current being a summation of the out-source current of each LED driver in the on-state;

(c) generating a dimming control output signal associated with the dimming command input signal across the one or more dimming interface terminals;

(d) estimating power characteristics of the one or more LED drivers and associated LED loads based on programmed relationships between the dimming control output signal and one or more operational parameters for a certain type of LED driver and LED load of the one or more LED drivers and associated LED loads.

2. The method of claim 1, further comprising prior to step (a):

programming the dimming controller with relationships between the received dimming command input signal and the one or more operational parameters for the certain type of LED driver and LED load.

3. The method of claim 1, wherein one of the power characteristics estimated in step (d) comprises an estimated power consumption of the one or more LED drivers and associated LED loads, the method further comprising:

(e) reporting the estimated power consumption of the one or more LED drivers and associated LED loads from the dimming controller to a user computing device.

4. The method of claim 1, comprising:

determining whether the one or more LED drivers are in an on-state based on the sensed out-source current; and generating the dimming control output signal associated with the dimming command input signal across the one or more dimming interface terminals when the one or more LED drivers are determined to be in an on-state.

5. The method of claim 4, further comprising:

determining a total number of LED drivers of the one or more LED drivers in the on-state and connected to the dimming controller by dividing the sensed total out-source current by a predetermined out-source current expected for each of one or more LED drivers, the predetermined driver out-source current being one of the one or more operational parameters for the certain type of LED driver.

6. The method of claim 1, wherein the programmed relationships between the received dimming control voltages and the one or more operational parameters for the certain type of LED driver and LED load include:

a relationship between an LED current for the certain type of LED load and the received dimming control voltage;

a relationship between the LED current for the certain type of LED load and an LED voltage for the certain type of LED load; and a relationship between a driver efficiency for the certain type of LED driver and an output power of each LED load of the one or more LED drivers.

7. The method of claim 1, wherein step (d) further comprises:

calculating an LED current of each LED load according to a predetermined and programmed relationship between an LED current for the certain type of LED load and the received dimming control voltage.

8. The method of claim 7, wherein step (d) further comprises:

calculating an LED voltage of each LED load according to a predetermined and programmed relationship between the calculated LED current for the certain type of LED load and an LED voltage for the certain type of LED load.

9. The method of claim 8, wherein step (d) further comprises:

calculating an output power of each LED load based at least in part on the calculated LED current and the calculated LED voltage of each LED load; and calculating an input power of the LED driver according to a predetermined and programmed relationship between the output power and a driver efficiency of the one or more LED driver for the certain type of LED driver.

10. The method of claim 8, wherein step (d) further comprises:

calculating a total output power of the one or more LED drivers and associated LED loads based at least in part on the calculated LED current of each LED load, the calculated LED voltage of each LED load, and a total number of LED drivers of the one or more LED drivers connected to the dimming controller and in an on-state, the total number of LED drivers calculated by dividing the sensed total out-source current by an individual out-source current of the each of one or more LED drivers; and calculating a total input power of the one or more LED drivers and associated LED loads according to a predetermined and programmed relationship between the total output power and a driver efficiency of the one or more LED driver for the certain type of LED driver.

11. An LED driving system for group control and power consumption estimation comprising:

one or more LED drivers coupled in parallel across a voltage source, each LED driver of the one or more LED drivers having an associated LED load, each LED driver configured to generate an out-source current at a dimming control interface of the respective LED driver when the LED driver is in an on-state;

a dimming controller coupled to the dimming control interface of each LED driver of the one or more LED drivers and configured to sense a total out-source current from the one or more LED drivers, the total out-source current being a summation of the out-source current of each LED driver in the on-state, generate a dimming control voltage for controlling an LED current generated by each of the one or more LED drivers and supplied to the associated LED load, and estimate power characteristics of the one or more LED drivers and associated LED loads based on programmed relationships between dimming control voltages and one or more operational parameters for a certain type of LED driver and a certain type of LED load of the one or more LED drivers and associated LED loads.

12. The LED driving system of claim 11, wherein:

the dimming controller is configured to operate in a first operational mode, a second operational mode, and a third operating mode;

in the first operational mode the dimming controller is programmed with the relationships between the dimming control voltages and the one or more operational parameters for the certain type of LED driver and the certain type of LED load of the one or more LED drivers and associated LED loads; and in the second operational mode the total out-source current is zero and the dimming controller monitors the total out-source current; and in the third operational mode the dimming controller is configured to estimate the power characteristics of the one or more LED drivers and associated LED loads connected thereto.

13. The LED driving system of claim 11, wherein:

each LED driver of the one or more LED drivers is identical and the associated LED load of each of the one or more LED drivers is identical.

14. The LED driving system of claim 13, wherein:

the out-source current of each of the one or more LED drivers is substantially constant for the certain type of LED driver; and the out-source current each of the one or more LED drivers is one of the one or more operational parameters for the certain type of LED driver programmed into the dimming controller.

15. The LED driving system of claim 11, wherein the programmed relationships between the received dimming control voltage and the one or more operational parameters for the certain type of LED driver and the certain type of LED load include:

a relationship between an LED current for the certain type of LED load and the received dimming control voltage;

a relationship between the LED current for the certain type of LED load and an LED voltage for the certain type of LED load; and a relationship between a driver efficiency for the certain type of LED driver and an output power of each LED load of the one or more LED drivers.

16. A dimming control apparatus comprising:

one or more terminals configured to receive connections to one or more LED drivers, said LED drivers configured in parallel across a voltage source for driving respective LED loads;

a voltage control circuit for generating a dimming control signal across the one or more terminals and to each of the one or more LED drivers when connected thereto;

a current sensing resistor coupled to at least one of the one or more terminals for sensing a total out-source current from the one or more LED drivers;

a controller configured to receive an external dimming command, generate the dimming control signal based on the received dimming command, monitor the total out-source current sensed by the current sensing resistor, and estimate power characteristics of the one or more LED drivers and associated LED loads based on programmed relationships between a generated dimming control signal and one or more operational parameters for a certain type of LED driver and a certain type of LED load of the one or more LED drivers and associated LED loads; and a communications module configured to transmit the dimming command to the controller, receive the estimated power characteristics from the controller, and report the estimated power characteristics to a server.

17. The dimming control apparatus of claim 16, wherein:

the communications module is further configured to program the controller with the relationships between the dimming control signal and the one or more operational parameters for the certain type of LED driver and the certain type of LED load.

18. The dimming controller of claim 16, wherein:

each of the one or more LED drivers is identical and each respective LED load of each of the one or more LED drivers is identical.

19. The dimming controller of claim 16, wherein the relationships between the dimming control signal and the one or more operational parameters for the certain type of LED driver and the certain type of LED load that are programmed into the controller include:

a relationship between an LED current for the certain type of LED load and the dimming control signal;

a relationship between the LED current for the certain type of LED load and an LED voltage for the certain type of LED load; and a relationship between a driver efficiency for the certain type of LED driver and an output power of each LED load of the one or more LED drivers.

20. The dimming controller of claim 16, wherein:

at least one of the one or more operational parameters for the certain type of LED driver is an individual outsource current generated by each respective LED driver of the one or more LED drivers.

* * * * *